US011015901B2

(12) United States Patent
Ma et al.

(10) Patent No.: US 11,015,901 B2
(45) Date of Patent: May 25, 2021

(54) WIRELESS CONTROL STRUCTURE OF AN AIMING DEVICE

(71) Applicants: Jialei Ma, Shaanxi (CN); Yongliang Chen, Guizhou (CN); Xiaolu Zuo, Guizhou (CN)

(72) Inventors: Jialei Ma, Shaanxi (CN); Yongliang Chen, Guizhou (CN); Xiaolu Zuo, Guizhou (CN)

( * ) Notice: Subject to any disclaimer, the term of this patent is extended or adjusted under 35 U.S.C. 154(b) by 0 days.

(21) Appl. No.: 16/669,512

(22) Filed: Oct. 30, 2019

(65) Prior Publication Data

US 2021/0095937 A1 Apr. 1, 2021

(30) Foreign Application Priority Data

Sep. 27, 2019 (CN) ..... 201921622648.7

(51) Int. Cl.
*F41G 1/46* (2006.01)
*F41G 1/54* (2006.01)

(52) U.S. Cl.
CPC ..... *F41G 1/545* (2013.01); *F41G 1/46* (2013.01)

(58) Field of Classification Search
CPC ..... F41G 1/545; F41G 1/46
USPC ..... 235/404
See application file for complete search history.

(56) References Cited

U.S. PATENT DOCUMENTS 10,317,172 B1 * 6/2019 Morgan ..... F41G 1/545

* cited by examiner

*Primary Examiner* — Daniel A Hess

(57) ABSTRACT

The invention discloses a wireless control structure of an aiming device comprising a remote controller and a wireless receiver connected wirelessly therewith. Said wireless receiver is installed on the aiming device and is connected with the switch of aiming device; said remote controller includes the remote control chip and keys, indicator light and transmit antenna connected with the remote control chip; said wireless receiver includes the receiving chip and receiving antenna connected therewith. The invention has achieved wireless control of aiming device via a wireless control structure of aiming device and simplified control structure of current aiming device, making the control of aiming device more convenient and visually beautiful.

3 Claims, 1 Drawing Sheet

WIRELESS CONTROL STRUCTURE OF AN AIMING DEVICE

BACKGROUND OF THE INVENTION

1. Field of the Invention

The invention relates to the technical field of components of an aiming device, specifically relating to a wireless control structure of an aiming device.

2. Description of the Related Art

Traditional laser aimers are all controlled by one type of spring line switch which is neither convenient nor visually beautiful and tends to be entangled with other objects as a line is attached to the gun. As a result, shooting is greatly affected and aiming device cannot develop further in function, diversification and innovation. Therefore, designing a wireless control structure of the aiming device becomes an urgent problem that demands to be resolved by people skilled in the art.

SUMMARY OF THE INVENTION

To solve above technical problems, the invention provides following technical plan: a wireless control structure of an aiming device comprising a remote controller and a wireless receiver connected wirelessly therewith. Said wireless receiver is installed on the aiming device and is connected with the switch of aiming device; said remote controller includes remote control chip and keys, indicator light and transmit antenna connected with the remote control chip; said wireless receiver includes the receiving chip and receiving antenna connected therewith.

The improvement includes one end of said transmit antenna is connected with supply terminal VCC via inductor L1 and another end thereof is connected with pin 3 of transistor Q2; pin 2 of said transistor Q2 is connected to ground and pin 1 is connected with pin TX of the remote control chip via resistor R5; said key Klis connected with pin K1 of the remote control chip and key K2 is connected with pin K2 of the remote control chip; the positive terminal J1 of said indicator light is connected with supply terminal VCC via resistor R1 and the negative terminal J2 of said indicator light is connected to ground.

The improvement includes the crystal oscillator Y1, the field-effect tube Q1, the battery BT1 and the battery BT2. Said crystal oscillator Y1 is connected with the inductor L1 and pin 1 of the transistor Q2 while another pin of crystal oscillator Y1 is connected to ground between which and pin1 of transistor Q2 is connected with the capacitor C2. Pin 3 of said field-effect tube Q1 is connected with supply terminal VCC and the resistor R2 is connected between pin 2 and pin 1 while pin 1 of said field-effect tube Q1 is connected with key K2 and key K1 via resistor R4. Positive Electrode of said battery BT2 is connected with resistor R2 while the negative electrode is connected with the positive electrode of the battery BT1 and the negative electrode of the battery BT1 is connected to ground.

As an improvement, pin of said receiving antenna J3 is connected with pin ANT of the receiving chip via capacitor C3 and two ends of capacitor C3 are connected with ground line J4 via capacitor C4 and inductor L3; inductor L1 is connected between said receiving antenna J3 and ground line J4; pin VCC of said receiving chip is connected with supply terminal VCC while pin CTH of said receiving chip is connected to ground via capacitor C6, the ground terminal of which is connected with pin VCC of the receiving chip via capacitor C4; pin DO of said receiving chip is connected with the receiving data pin J23 while pin EN thereof is connected to ground; pin CAG of said receiving chip is connected to ground via capacitor C7 while pin OSC thereof is connected to ground via crystal oscillator Y2. Said positive terminal J2 of the power supply is connected with supply terminal VCC.

As an improvement, said remote control chip is EV1527 chip.

As an improvement, said receiving chip is SYN480R chip.

After employing above structure, the invention has following merits: The invention has achieved wireless control of aiming device via a wireless control structure of aiming device and simplified control structure of current aiming device, making the control of aiming device more convenient and visually beautiful.

DETAILED DESCRIPTION OF THE PREFERRED EMBODIMENTS

Figure 1:
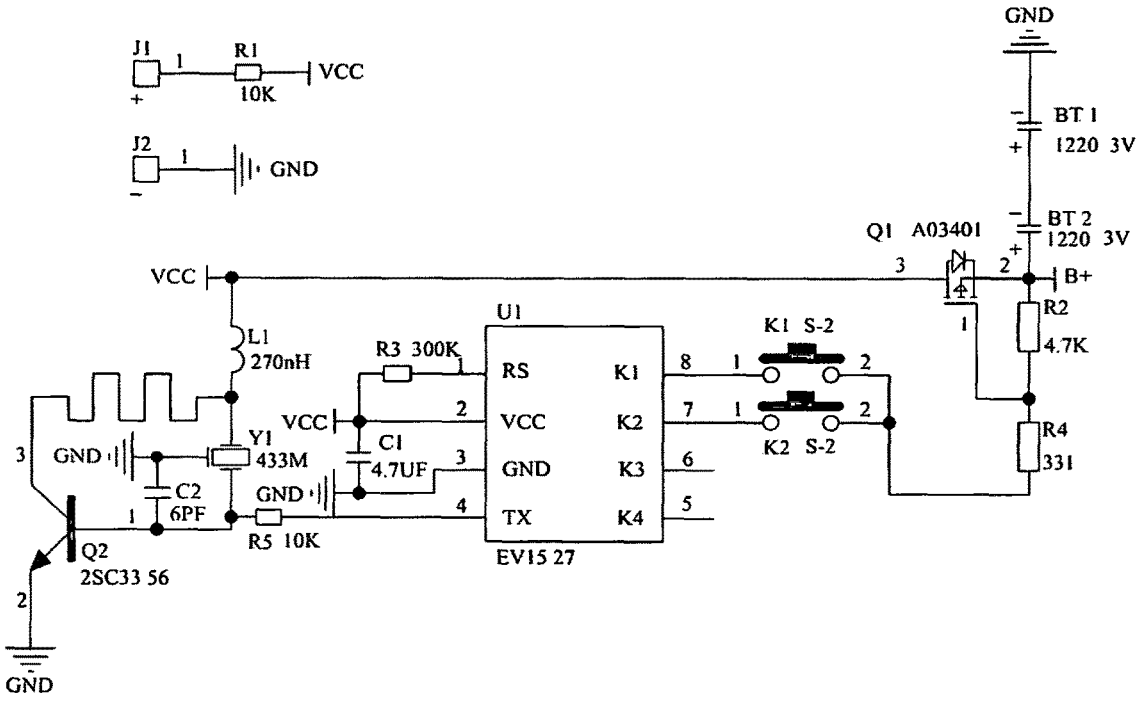
FIG. 1 is the circuit structure diagram illustrating the wireless control structure of the aiming device in the invention.
Figure 2:
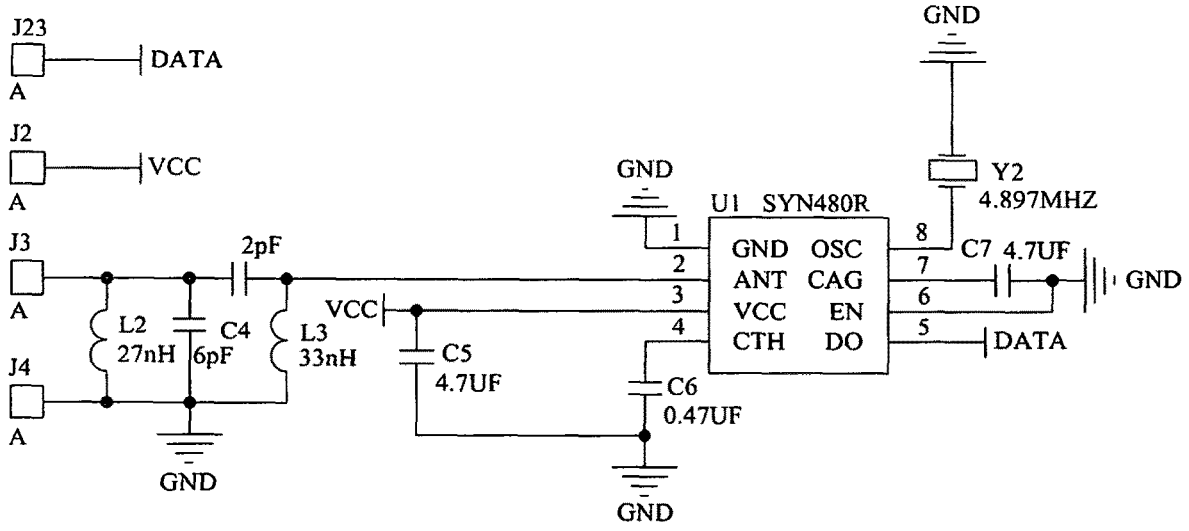
FIG. 2 is the circuit structure diagram illustrating the wireless receiver of the wireless control structure of the aiming device in the invention.

The invention is further described in detail hereinafter with reference to the drawings: a wireless control structure of the aiming device comprising a remote controller and a wireless receiver connected wirelessly therewith. Said wireless receiver is installed on the aiming device and is connected with the switch of aiming device; said remote controller includes the remote control chip and keys, indicator light and transmit antenna connected with the remote control chip; said wireless receiver includes the receiving chip and receiving antenna connected therewith.

As the preferred embodiment, one end of said transmit antenna is connected with supply terminal VCC via inductor L1 and another end thereof is connected with pin 3 of transistor Q2; pin 2 of said transistor Q2 is connected to ground and pin 1 is connected with pin TX of the remote control chip via resistor R5; said key Klis connected with pin K1 of the remote control chip and key K2 is connected with pin K2 of the remote control chip; the positive terminal J1 of said indicator light is connected with supply terminal VCC via resistor R1 and the negative terminal J2 thereof is connected to ground.

As the preferred embodiment, it also includes the crystal oscillator Y1, the field-effect tube Q1, the battery BT1 and the battery BT2. Said crystal oscillator Y1 is connected with the inductor L1 and pin 1 of the transistor Q2 while another pin of crystal oscillator Y1 is connected to ground between which and pin1 of transistor Q2 is connected with the capacitor C2. Pin 3 of said field-effect tube Q1 is connected with supply terminal VCC and the resistor R2 is connected between pin 2 and pin 1 while pin 1 of said field-effect tube Q1 is connected with key K2 and key K1 via resistor R4. Positive Electrode of said battery BT2 is connected with resistor R2 while the negative electrode is connected with the positive electrode of the battery BT1 and the negative electrode of the battery BT1 is connected to ground.

As the preferred embodiment, pin of said receiving antenna J3 is connected with pin ANT of the receiving chip via capacitor C3 and two ends of capacitor C3 are connected with ground line J4 via capacitor C4 and inductor L3; inductor L1 is connected between said receiving antenna J3 and ground line J4; pin VCC of said receiving chip is connected with supply terminal VCC while pin CTH of said receiving chip is connected to ground via capacitor C6, the ground terminal of which is connected with pin VCC of the receiving chip via capacitor C4; pin DO of said receiving chip is connected with the receiving data pin J23 while pin EN thereof is connected to ground; pin CAG of said receiving chip is connected to ground via capacitor C7 while pin OSC thereof is connected to ground via crystal oscillator Y2. Said positive terminal J2 of the power supply is connected with supply terminal VCC.

As the preferred embodiment, said remote control chip is EV1527 chip.

As the preferred embodiment, said receiving chip is SYN480R chip.

In particular implementation, the invention employs the wireless receiving and dispatching technology, through which the transmitting terminal EV1527 of the remote controller modulates and transmits synchronous coding+address code+data code via 315 MHZ/413 MHZ by adopting ASK modulation of saw resonator and the wireless receiver receives data and decode it to control work of laser aimer.

The invention and its embodiment have been described above, but the description is not limited thereto; only one embodiment of the invention is shown in the drawings, and the actual structure is not limited thereto. In general, it is to be understood by those skilled in the art that non-creative design of structural forms and embodiments that are similar to the technical solutions without departing from the spirit of the invention shall all fall within the protective scope of the invention.

The invention claimed is:

1. A wireless control structure of an aiming device, the wireless control structure comprising:

a remote controller and a wireless receiver connected wirelessly therewith;

said wireless receiver is installed on the aiming device and is connected with the switch of aiming device;

said remote controller includes the remote control chip and keys, indicator light and transmit antenna connected with the remote control chip; and said wireless receiver includes the receiving chip and receiving antenna connected therewith;

wherein one end of said transmit antenna is connected with supply terminal VCC via inductor L1 and another end thereof is connected with pin3 of transistor Q2; pin2 of said transistor Q2 is connected to ground and pin1 is connected with pin TX of the remote control chip via resistor R5; said key K1 is connected with pin K1 of the remote control chip and key K2 is connected pin K2 of the remote control chip; the positive terminal J1 of said indicator light is connected with supply terminal VCC via resistor R1 and the negative terminal J2 thereof is connected to ground.

2. The wireless control structure of an aiming device according to claim 1, wherein it also includes the crystal oscillator Y1, the field-effect tube Q1, the battery BT1 and the battery BT2; said crystal oscillator Y1 is connected with the inductor L1 and pint of the transistor Q2 while another pin of crystal oscillator Y1 is connected to ground between which and pin 1 of transistor Q2 is connected with the capacitor C2; pin3 of said field-effect tube Q1 is connected with supply terminal VCC and the resistor R2 is connected between pin 2 and pin 1 while pin1 of said field-effect tube Q1 is connected with key K2 and key K1 via resistor R4; positive electrode of said battery BT2 is connected with resistor R2 while the negative electrode is connected with the positive electrode of the battery BT1 and the negative electrode of the battery BT1 is connected to ground.

3. The wireless control structure of an aiming device according to claim 1, wherein pin of said receiving antenna J3 is connected with pin ANT of the receiving chip via capacitor C3 and two ends of capacitor C3 are connected with ground line J4 via capacitor C4 and inductor L3; inductor L1 is connected between said receiving antenna J3 and ground line J4; pin VCC of said receiving chip is connected with supply terminal VCC while pin CTH of said receiving chip is connected to ground via capacitor C6, the ground terminal of which is connected with pin VCC of the receiving chip via capacitor C4; pin DO of said receiving chip is connected with the receiving data pin J23 while pin EN thereof is connected to ground; pin CAG of said receiving chip is connected to ground via capacitor C7 while pin OSC thereof is connected to ground via crystal oscillator Y2; said positive terminal J2 of the power supply is connected with supply terminal VCC.

* * * * *